United States Patent [19]

Smith et al.

[11] Patent Number: 5,014,978

[45] Date of Patent: May 14, 1991

[54] METHOD AND APPARATUS FOR THE SEQUENTIAL HANDLING OF FLEXIBLE PRODUCTS

[75] Inventors: David A. Smith, Midland; Herb Geiger, Bay City, both of Mich.

[73] Assignee: The Dow Chemical Company, Midland, Mich.

[21] Appl. No.: 286,205

[22] Filed: Dec. 19, 1988

[51] Int. Cl.[5] ..... B65H 29/54

[52] U.S. Cl. ..... 271/308; 271/310; 271/313; 271/197

[58] Field of Search ..... 271/194–197, 271/306–312, 276, 277, 313; 414/790.9, 794.7, 793.9; 198/434, 436, 438, 440, 441; 209/553

[56] References Cited

U.S. PATENT DOCUMENTS

| | | | |
|---|---|---|---|
| Re. 28,172 | 9/1974 | Bradley et al. | 271/196 |
| 1,884,397 | 10/1932 | Upham | 271/308 |
| 3,067,871 | 12/1962 | Lyon et al. | 209/553 |
| 3,254,889 | 6/1966 | Nystrand | 271/69 |
| 3,450,402 | 6/1969 | Weiler | 271/308 |
| 3,498,600 | 3/1976 | Spencer et al. | 271/69 |
| 3,640,050 | 2/1972 | Nystrand et al. | 53/120 |
| 3,683,730 | 8/1972 | Driessen | 271/74 X |
| 4,073,223 | 2/1978 | Crawford | 271/69 X |
| 4,166,030 | 8/1979 | Lewis et al. | 209/553 X |
| 4,467,908 | 8/1984 | Schneider | 198/441 |
| 4,523,671 | 6/1985 | Campbell | 271/299 X |

FOREIGN PATENT DOCUMENTS

| | | | |
|---|---|---|---|
| 0159971 | 12/1979 | Japan | 198/441 |

*Primary Examiner*—Michael S. Huppert
*Assistant Examiner*—Kenneth DeRosa

[57] ABSTRACT

The present invention provides an improved apparatus and method for the sequential handling of a series of flexible products which enables operation of the orbital packing fingers at lower speeds to reduce inertial loading and yet maintain a high output rate. In preferred embodiments of the invention, the packing fingers are operated at a rate of 1/X times the rate that flexible products are provided. Where X is the number of delivery points per lane of flexible products provided. The orbital packing fingers themselves are constructed to extend across substantially the entire width of the bags as they are stripped from a transfer drum and to decelerate the bags as they are stacked against a backstop.

28 Claims, 8 Drawing Sheets

METHOD AND APPARATUS FOR THE SEQUENTIAL HANDLING OF FLEXIBLE PRODUCTS

BACKGROUND OF THE INVENTION

This invention relates to a method and apparatus for the sequential handling of a series of individual flexible products, and more particularly to a high speed handling and delivery system for flexible plastic bags or containers.

In the production of individual flexible web products such as plastic containers and bags, the bag stock is typically supplied in the form of a continuous web of thermoplastic material which has been folded upon itself to form two plies. In forming individual bags, portions of the thermoplastic material are severed from the web. These severed areas become side seams for the bags and are typically sealed at the same time as they are severed by the use of a heated wire element. The bags are then stacked, counted, and packaged by packing equipment.

The severing and sealing operation typically takes place on a relatively large diameter rotating drum which may contain multiple heated wire severing and sealing elements positioned in grooves located within the outer periphery of the drum. As the drum rotates, different severing and sealing elements are actuated to raise them up to the drum surface to sever and seal a respective portion of the bag stock web. The individual bags are retained on the drum by a vacuum arrangement as the drum rotates. Such drums are large and expensive pieces of equipment. However, they can presently be operated at production speeds in excess of the production speed of the packaging equipment. Present commercial drums are capable of operating simultaneously on a pair of bag webs positioned side-by-side on the drum.

Individual bags are then taken from the drum, stacked, and packaged. Desirably, the packaging operation occurs at the highest possible speed the equipment can be operated to increase productivity of the system. Presently, individual bags are taken from the drum by a smaller transfer drum, also suitably equipped with vacuum capabilities. The vacuum on the bags on the large drum is relieved at an appropriate point, and the bags fall onto the smaller drum where they are held in position by vacuum. At an appropriate point, the vacuum is released and the individual bags are pulled off the smaller drum by an orbital packer or similar device. Again, present commercial equipment is designed to remove side-by-side pairs of bags simultaneously and package those bags with separate pieces of packaging equipment.

As is conventional, the orbital packing device is provided with a set of packer fingers which move in a circular path in precise timing with the smaller drum so that the fingers remove successive bags, which are typically separated on the drum approximately a nominal ⅛ inch from each other, from the drum and stack them on a stacking table against a backstop. These orbiting packer fingers must move at very high speeds to strip each successive bag from the drum and may actually accelerate the bags toward the backstop. Such acceleration of the bags is undesirable as the bags may bounce or crumple when they hit the backstop. This leads to machine jams, causing excessive downtime for the machinery.

Even if the machinery does not jam, the stack of bags which is formed on the stacking table may be uneven so that when the stack is boxed, bags may be left hanging out of the box. Such boxes must be removed from the assembly line and repacked by hand. Even minor unevenness of the bag stack may make it more difficult for a consumer to dispense the bags from a box. If one or more of the bags in the stack is crumpled, the vertical height of the stack is affected so that when the count fingers are activated to separate the previous precounted stack from the next stack, the fingers may strike the stack. Again, this leads to machine jams and downtime for the machinery.

Another problem in conventional orbital packing devices is that the packer fingers contact substantially less than the full bag width as they move out of the grooves and strip the bag from the surface of the transfer drum. At typical operating speeds, the stingers accelerate the bags vertically downwardly away from the transfer drum surface at a high velocity. In some instances, this may cause the trailing edge of a bag, which is not in contact with the packer fingers, to fold up and over against itself. Longer packer fingers which would extend across the entire width of the bag are not possible in conventional equipment as the fingers would tend to contact the leading edge of the next succeeding bag on the drum. A folded bag placed on the bag stack again affects the height of the stack so that the count fingers may not operate properly to remove the stack from the stacking table. Additionally, such a folded bag may also cause a jam from the next bag striking the folded trailing edge.

Both the orbiting packer fingers as well as the count fingers are subjected to high inertial forces. After a predetermined number of bags have been removed, count fingers or other suitable separation means are actuated to separate the continuous stream of individual bags into precounted stacks. To accomplish this, the count fingers must move from a first position fully out of the stream of bags, to a second position fully in the stream. This movement must be accomplished in the fraction of a second between successive bags as they are delivered from the smaller drum. At high production rates, this time can be less than 0.1 seconds. This results in the production of tremendous acceleration forces on the count fingers as high as 30 times the force of gravity. High inertial forces also affect the remainder of the packaging system for the folding and loading of the product into dispensers. Thus, operation at the design limits of the packing equipment results in high inertial loading which is detrimental to machinery life and results in excessive downtime and maintenance costs.

Attempts have been made in the past to increase the production rates of packing systems by providing multiple lane stacking systems for relatively thick and/or stiff products such as diapers (Campbell, U.S. Pat. No. 4,523,671) and slices of wrapped cheese or meat (Driessen, U.S. Pat. No. 3,683,730). Both Campbell and Driessen teach systems for the side shifting of individual items from a single path to a plurality of paths. However, such systems were not designed for the stacking of relatively thin, flexible products such as plastic bags which may become folded over and cause machine jams.

Accordingly, it would be desirable to be able to utilize the capability of the product drum to produce products at the higher rates that it is capable of and yet maintain or even increase the higher production rates without subjecting the packaging system to such high inertial forces. The need still exists in the art for such a high speed product handling and delivery system and method for handling relatively thin, flexible products such as plastic bags.

SUMMARY OF THE INVENTION

The present inVention meets those needs by providing an improved apparatus and method for the sequential handling of a series of flexible products which enables operation of the orbital packing fingers at lower speeds to reduce inertial loading and yet maintain a high overall output rate. Further, the orbital packing fingers themselves are constructed to extend across substantially the entire width of the bags as they are stripped from a transfer drum and to decelerate the bags as they are stacked against a backstop. Further, the surfaces of the packing fingers in contact with the bags may be designed to provide selective frictional drag to decelerate the bags as they are removed from a transfer drum and stacked In accordance with one aspect of the present invention, an apparatus for the sequential handling of individual flexible products is provided which includes means for delivering a series of individual flexible products to a transfer point and means positioned at the transfer point for transferring the flexible products to a delivery point. The means at the transfer point include a vacuum transfer drum having a plurality of annular grooves extending inwardly substantially normal to the axis of rotation of said drum about the periphery thereof and means for rotating the drum. Adjacent the transfer drum is an orbital packing mechanism including a shaft positioned for orbital movement, drive means for orbiting the shaft, and a plurality of packer fingers secured to the shaft and extending into the annular grooves on the transfer drum for removing the flexible products sequentially from the transfer drum and delivering them to the delivery point. The fingers have surfaces which are adapted to contact the flexible products. Further, in a preferred embodiment, the fingers are designed to extend and contact across substantially the full radial width of the flexible products as the products are removed from the transfer drum to prevent bag fold over problems.

The surface of the fingers in contact with the flexible products may be designed to provide a selective frictional drag between the flexible products and the finger when the flexible products are moving at a high velocity relative to the finger surfaces and a low friction when the velocity of the finger surfaces are increasing relative to the velocity of the flexible products. This frictional drag tends to decelerate the flexible products as they are stacked, reducing bag crumpling, fold over, and bounce problems.

To enable operation of the orbital packing fingers at lower speeds and yet maintain the overall output of the system constant, the spacing of the flexible products on the transfer drum should be increased to from approximately ⅝ inches between individual products to up to an entire bag width. This increased spacing may be accomplished in a number of ways. Initially, the surface speed of the transfer drum may be increased so that it is greater than the surface speed of the product drum. In this manner, individual flexible products removed from the product drum will be spaced out about the periphery of the transfer drum. Other techniques may employ a side-shifting transfer drum to provide two or more lanes of product to the orbital packing equipment as taught in commonly assigned copending U.S. application Ser. No. 200,283 filed May 31, 1988, or a plurality of transfer drums as taught in commonly assigned copending U.S. application Ser. No. 159,133, filed Feb. 23, 1988.

In one embodiment of the invention in which a side-shifting transfer drum is utilized, a high speed multiple lane system for delivering a series of individual flexible products to a plurality of delivery points is provided and includes means for providing a series of individual flexible products to a transfer point and means for transferring individual ones of the flexible products from the transfer point to a plurality of delivery points The transfer means includes a vacuum transfer drum having a plurality of annular grooves extending inwardly substantially normal to the axis of rotation of said drum about the periphery thereof, and also includes means for rotating the vacuum transfer drum.

The transfer drum also includes a plurality of alternating first and second segments, the first segments being movable transverse to the path of movement of the flexible products. These first segments are adapted to accept alternating ones of the flexible products from the transfer point and include vacuum ports in communication with the vacuum source for securing the leading edges of the flexible products. The second segments are adapted to accept alternating ones of the flexible products. Means are also provided for moving the first segments transverse to the path of movement of the flexible products.

Adjacent the transfer drum is an orbital packing mechanism including a shaft positioned for orbital movement, drive means for orbiting the shaft, and a plurality of packer fingers secured to the shaft and extending into the annular grooves on the transfer drum for removing the flexible products sequentially from the first and second segments on the transfer drum and delivering them to the plurality of delivery points. The fingers have surfaces adapted to contact the flexible products. Optionally, the fingers extend and contact across substantially the full radial width of the flexible products as the products are removed from the transfer drum.

For the extended length packing fingers used in this embodiment of the present invention which utilizes side-shifting transfer drum segments, it is preferred that the grooves in the periphery of the transfer drum have a width of about twice the width of the fingers. The grooves may also include a tapered entry section to facilitate movement of the fingers into and out of the grooves on the transfer drum. If desired, guides may be positioned adjacent individual ones of the fingers for maintaining the fingers in alignment with the grooves.

Because each set of packer fingers at a packing station removes only alternating ones of the flexible products, there is sufficient space so that the longer fingers will not encounter a succeeding product. Further, due to this arrangement, each packing station may be operated at only 1/X the speed of a conventional machine, where X is the number of packing stations per lane of flexible products. Currently, commercial product drums are capable of operating on two or more lanes of flexible web products simultaneously. This lower operating speed reduces inertial loading forces on the finger mechanisms and also eliminates bag acceleration problems. However, as the number of stations of packing fingers has been increased, the overall output of the packaging machinery remains the same.

In this embodiment of the invention, and in the embodiments described below utilizing a plurality of transfer drums, the velocity of the fingers relative to the velocity of the flexible products as the products are removed from the transfer drum is of a magnitude and direction which will tend to decelerate the flexible products. This relative velocity is measured along the line of contact between the surface of the fingers and the flexible products. This deceleration of the flexible products as they are removed from the transfer drum and stacked on the stacking table against a backstop reduces bag crumpling, fold over, and bounce problems.

In another embodiment of the invention, in which a plurality of transfer drums are utilized, a high speed product delivery system is provided which includes means for providing a series of individual flexible products sequentially to a transfer point and means for transferring individual ones of the products from the transfer point to a plurality of delivery points. The transfer means includes a plurality of vacuum transfer drums, with each of the drums having a plurality of annular grooves extending inwardly substantially normal to the axis of rotation of said drum about the periphery thereof and means for rotating the drums. The drums are arranged such that the first of the plurality of transfer drums accepts products from the providing means and transfers at least a portion of the individual products to a succeeding transfer drum and at least a portion of the individual products to a first delivery point. Each succeeding transfer drum is positioned to deliver at least that portion of the individual products received from the first transfer drum to succeeding delivery points.

Adjacent each of the plurality of transfer drums at individual delivery points is an orbital packing mechanism including a shaft positioned for orbital movement, drive means for orbiting the shaft, and a plurality of packer fingers secured to each shaft and extending into the annular grooves on the transfer drums for removing the flexible products sequentially from the transfer drum and delivering them to the plurality of delivery points. The fingers have surfaces adapted to contact the flexible products. Optionally, the fingers extend and contact across substantially the full radial width of the flexible products as the products are removed from each of the transfer drums.

In an alternate embodiment of the invention which also utilizes a plurality of transfer drums, the handling and delivery system includes means for providing a series of individual flexible web products sequentially to a pluralitY of transfer points positioned about the periphery of a means for providing the products such as a rotating product drum.

The system also includes means for transferring individual products from each of the transfer points to a plurality of corresponding delivery points. The transfer means include a plurality of vacuum transfer drums and means for rotating those drums. The drums are so arranged that the first of the transfer drums accepts individual products from the product drum at the first transfer point, while succeeding transfer drums accept products from the product drum at succeeding transfer points.

Adjacent each of the plurality of transfer drums at individual delivery points is an orbital packing mechanism including a shaft positioned for orbital movement, drive means for orbiting the shaft, and a plurality of packer fingers secured to each shaft and extending into the annular grooves on the transfer drums for removing the flexible products sequentially from the transfer drum and delivering them to the plurality of delivery points. The fingers have surfaces which are adapted to contact the flexible products. Optionally, the fingers extend and contact across substantially the full radial width of the flexible products as the products are removed from each of the transfer drums.

The present invention also provides a method for the sequential handling of individual flexible products which includes the steps of delivering a series of individual flexible products to a transfer point and then transferring the flexible products from the transfer point to a delivery point by transferring the flexible products onto a rotating vacuum transfer drum having a plurality of annular grooves extending inwardly substantially normal to the axis of rotation of said drum about the periphery thereof. The flexible products are removed sequentially from the transfer drum and delivered to the delivery point using a plurality of orbital packing fingers which extend into the annular grooves in the transfer drum. Optionally, the fingers extend and contact across substantially the full radial width of the flexible products as the products are removed from the transfer drum.

In those embodiments of the invention which utilize a plurality of transfer drums or a transfer drum with side-shifting segments, preferably the relative velocity of the surface of the fingers in contact with the flexible products is equal to or less than the velocity of the flexible products as the products are removed from the transfer drum. In these embodiments of the invention, the orbital packing fingers may be operated at 1/X the rate at which the sequential flexible products are moving on the product drum, where X is the number of packing stations per lane of flexible products or the total number of transfer drums. Thus, fewer inertial forces are imposed on the orbital packing mechanism while maintaining the same overall packaging capacity of the machinery.

Accordingly, it is an object of the present invention to provide an apparatus and method for the sequential handling and delivery of individual flexible products without subjecting the apparatus to high inertial loading which is detrimental to the apparatus. It is a further object to provide a method and apparatus which improves the stacking of flexible products and reduces product jams and machinery down time. These, and other objects and advantages of the present invention, will become apparent from the following detailed description, the accompanying drawings, and the appended claims.

DETAILED DESCRIPTION OF THE PREFERRED EMBODIMENTS

Figure 1:
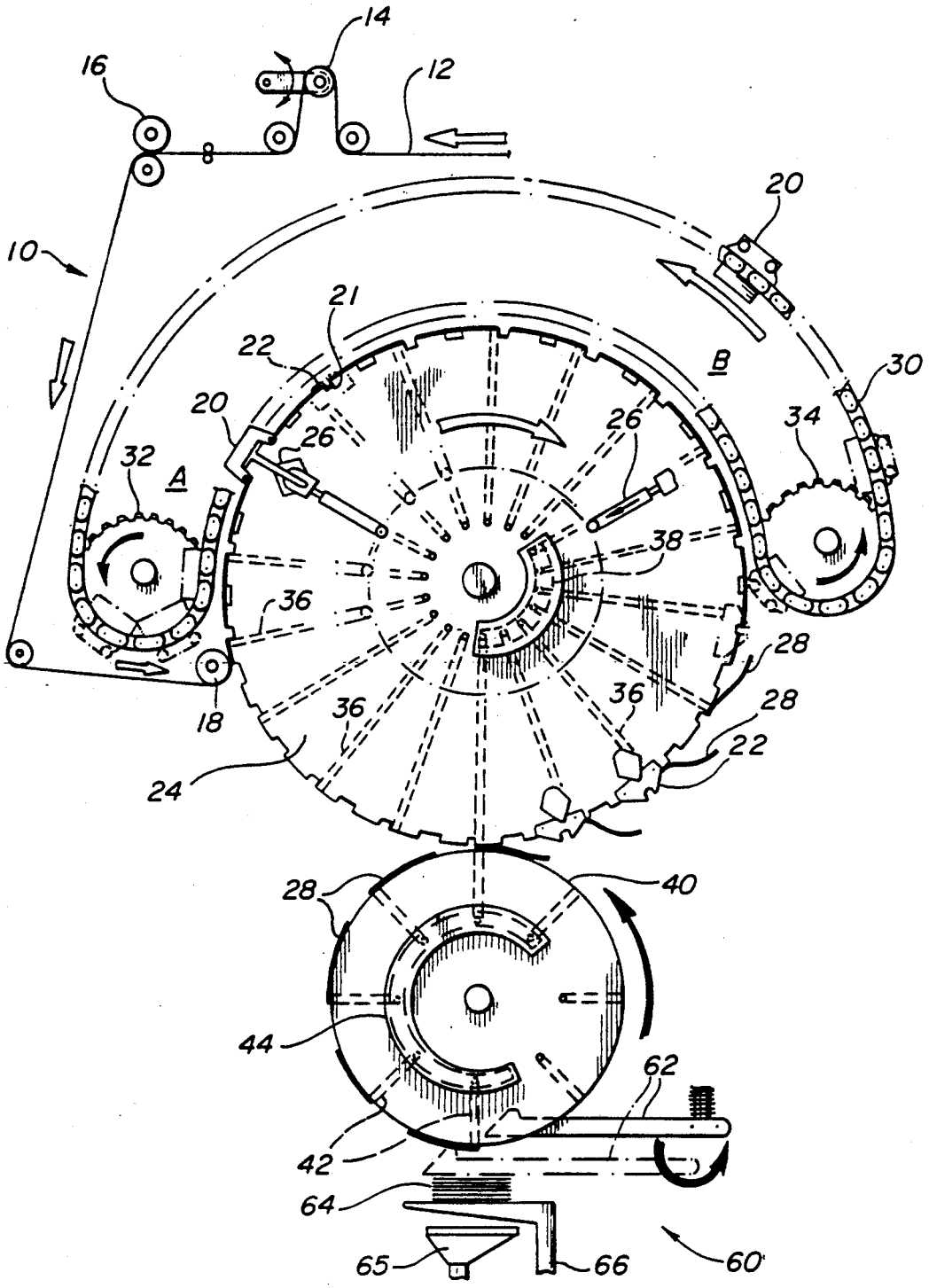
FIG. 1 is a schematic side elevational view of one embodiment of the sequential handling and delivery system of the present invention.

Referring now to FIG. 1, one embodiment of the sequential product handling and delivery system of the present invention is illustrated in schematic form. The handling and delivery system generally indicated at 10 receives a continuous web, designated film web 12, from a spool (not shown) or directly from an extrusion line. While the invention will be described in the context of a web of thermoplastic material used to form individual plastic bags or containers, it will be apparent to those skilled in the art that the handling and delivery system of the present invention is applicable to other products which are fed from a continuous web and then divided into individual flexible products.

Film web 12 may either be a zippered or unzippered bag stock being folded on itself to provide a two ply film. Film web 12 is caused to pass over dancer roll 14 which acts to control film web tension based on its vertical positioning. Film web 12 is then pulled through a draw roll arrangement 16 which is driven at a speed slightly in excess of the rotational speed of product drum 24. This type of operation permits some slack in the film as it is being fed onto vacuum product drum 24. Vacuum product drum 24 is driven by drive means (not shown) in a conventional manner. The film web 12 then passes over a lay-on roll 18 which is located to position the film web accurately against the rotating product drum surface.

Film web 12 is then severed and sealed on product drum 24 in the following manner. Film web 12 is clamped tightly to the outer surface of product drum 24 at a severing and sealing edge of a heating element slot 21 by seal bar assembly 20. Seal bar assembly 20 is aligned in proper position through the use of yokes 22 on the product drum 24. As product drum 24 rotates in the direction of the arrow, a heated wire severing and sealing element assembly, shown generally at 26, operably through a cam assembly (not shown), emerges from a recess in product drum 24 and severs film web 12 at position A.

The severing and sealing element remains extended for approximately 120 degrees of rotation of the product drum until the severing and sealing element 26 is withdrawn as shown schematically at position B. During the time that the element is extended, the film melts back to the edge of the seal bar assembly 20 and a bead seal forms along the edge of the bag. This melt back of the thermoplastic film results in a nominal ⅛ inch spacing between adjacent bags on product drum 24. The spacing further aids in preventing adjacent bags from touching and resealing to each other. Individual bags 28 are formed by the severing and sealing of the film web at adjacent sever and seal stations on the product drum.

Just prior to the release of the clamping force of the seal bar assembly 20, a vacuum is applied to the leading edge of individual bags 28. Seal bar assembly 20 is removed from the product drum by a continuous chain drive 30 having sprockets 32 and 34 located on opposite sides of product drum 24. The chain drive permits precise positioning of the individual seal bar assemblies 20 along the surface of the product drum.

Individual bags 28 are held in position on rotating product drum 20 by respective vacuum ports 36 which communicate with a central manifold 38, which in turn communicates with a vacuum source (not shown). As shown, as product drum 24 rotates, vacuum ports 36 are brought into and out of communication with manifold 38. This construction causes a vacuum to be applied to the leading edges of bags 28 beginning at a point just prior to the removal of seal bar assembly 20 until just prior to transfer to transfer drum 40.

Bags 28 are held onto rotating transfer drum 40 by a similar vacuum system. Vacuum ports 42 communicate with a central manifold 44, which in turn communicates with a vacuum source (not shown). As shown, at a point approximately along a line between the centers of product drum 24 and transfer drum 40, the vacuum is relieved from product drum 24. Gravity then causes the bags 28 to fall toward drum 40 where a corresponding vacuum port 42 is activated.

The vacuum ports 42 on transfer drum 40 are positioned so that each individual bag 28 is removed from the product drum. As shown, each vacuum port is active during rotation of first transfer drum 40 until a point approximately in vertical alignment with packing device 60. As bags 28 are brought around transfer drum 40, vacuum ports 42 hold onto the bags until they reach a nearly horizontal position where the vacuum is released.

In packing device 60, orbital packer fingers 62 extend into annular grooves on the surface of transfer drum 40 and pull the individual bags away from the drum surface and deposit the bags into a stack 64 on delivery table 65. As shown by the phantom lines, as well as by the view in FIG. 4, fingers 62 extend and contact across substantially the full radial width of bags 28 as the bags are removed from drum 40. While packing device 60 is illustrated as a substantially horizontal stacking table 65 and packer fingers 62 extend substantially horizontally, it will be appreciated that the packing device and associated components may be positioned at an acute angle from the horizontal configuration shown.

The surface of fingers 62 which contact bags 28 may be specially treated or finished to provide a selective frictional drag between the flexible products and the surfaces of the fingers. By selective frictional drag it is meant to provide a high degree of friction during the time when bags 28 are moving at a high velocity relative to the finger surface and a low degree of friction when the velocity of the finger surfaces is increasing relative to the velocity of the flexible products. As shown in FIGS. 2B and 2C, the selective frictional drag may be provided through the use of an elongated saw tooth pattern 62*a*, or a series of angled projections 62*b*. Other known techniques for producing such surfaces may be utilized, such as for example, the use of a "fish scale" pattern as is used on the bottoms of cross country skis. This high degree of friction will tend to decelerate the bag as it is stacked on table 65.

At a precise time, count fingers 66 pivot between a first position (not shown) which is completely out of the stream of bags into the position shown to separate the stack 64 of bags into the desired count. The delivery table 65 may be lowered to permit a clamp assembly (not shown) to clamp the stack of bags and transfer it to further conventional equipment for packaging the bags.

In the embodiment of the invention illustrated in FIG. 1, to enable the longer packer fingers 62 to strip bags 28 from drum 40 without encountering a succeeding bag the spacing between the individual bags must be increased from the nominal ⅛ inches on the product drum to up to an entire bag width. This is accomplished in the system of FIG. 1 by operating transfer drum 40 at a surface speed which is somewhat greater than the surface speed of product drum 24. To accomplish this, drum 40 may be rotated at the same nominal rate as the transfer drums in other embodiments of the invention but will have a larger diameter. Thus, the speed of the outer surface of the transfer drum will increase. Care must be taken in selecting the surface speed of the transfer drum so that bags 28 are not accelerated unduly as they are transferred from product drum 24.

Figure 2A:
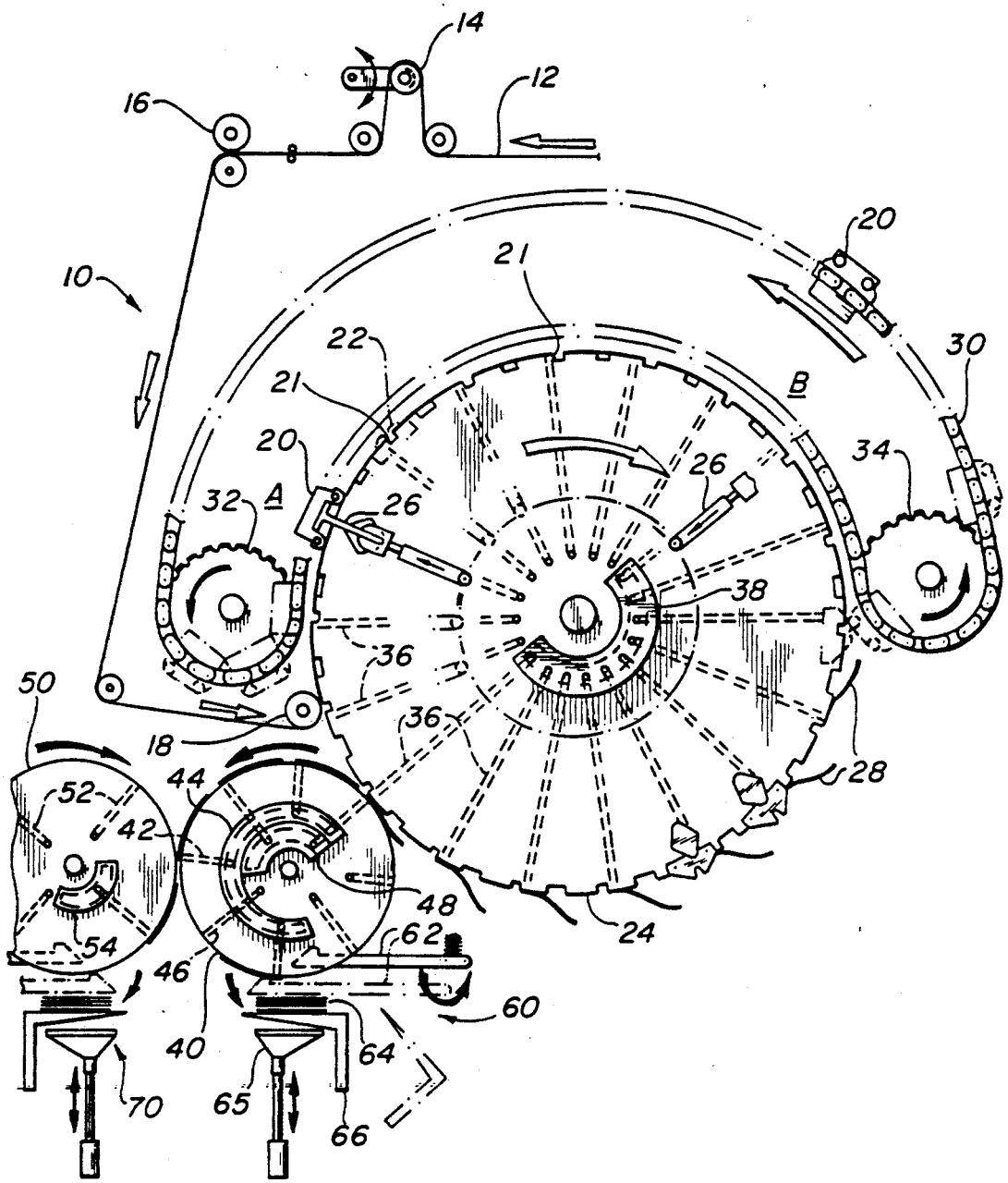
FIG. 2A is a schematic side elevational view of a dual transfer drum embodiment of the sequential handling and delivery system of the present invention.
Figure 2B:
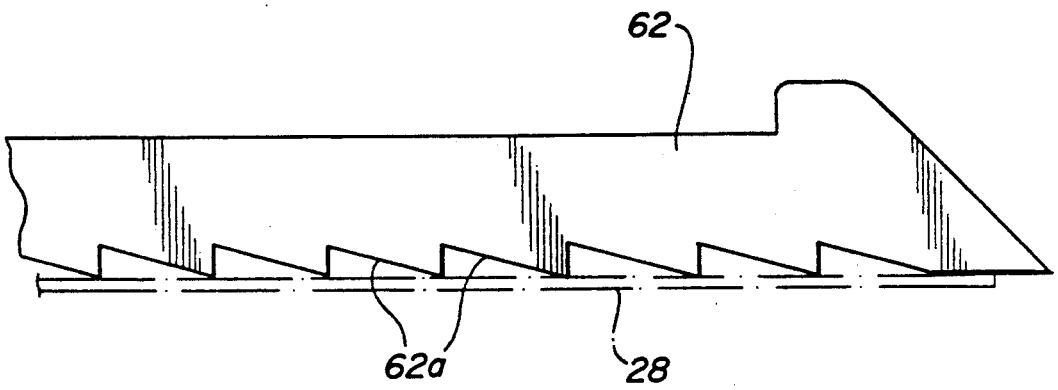
FIGS. 2B and 2C are greatly enlarged sectional views of exemplary surface patterns on the packer fingers to provide selective frictional drag.
Figure 2C:
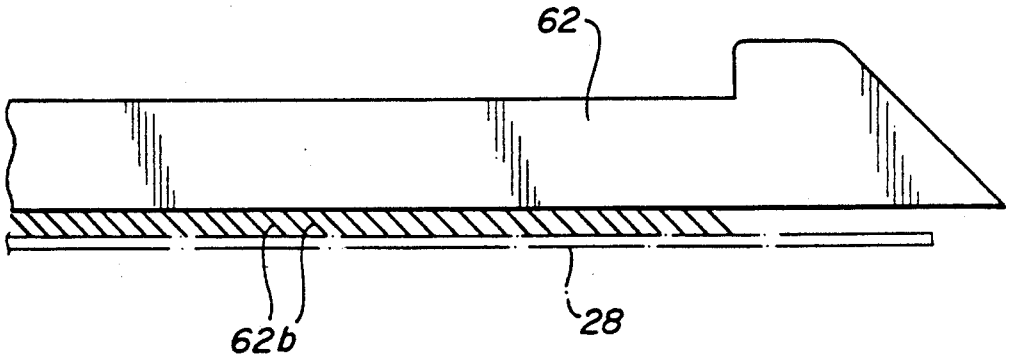

In another embodiment of the invention illustrated in FIG. 2A, in which like reference numerals refer to like elements, a plurality of transfer drums are utilized. The operation of the system is similar to the embodiment of the invention illustrated in FIG. 1 except that first transfer drum 40 is equipped with two sets of vacuum ports 42 and 46. A first set of vacuum ports 42 communicate with a first central manifold 44, which in turn communicates with a vacuum source. A second set of vacuum ports 46 communicate with a second central manifold 48, which in turn communicates with the vacuum source (not shown). As shown, at a point approximately along a line between the centers of product drum 24 and first transfer drum 40, the vacuum is relieved from product drum 24. Gravity then causes the bags 28 to fall toward drum 40 where a corresponding vacuum port 42 is activated.

The first and second sets of vacuum ports 42 and 46 on transfer drum 40 are positioned so that each individual bag 28 is removed from the product drum. As shown, each set of vacuum ports is active during rotation of first transfer drum 40 until a point approximately along the centerline between first transfer drum 40 and second transfer drum 50. At that point, bags 28 secured to ports 42 will be released and then picked up by the vacuum system on transfer drum 50. Bags 28 will be transferred to second transfer drum 50 by vacuum ports 52 which communicate with a central manifold 54 which in turn communicates with a vacuum source (not shown).

In this manner, the stream of individual bags may be divided into two streams which can then be delivered to separate packing devices 60 and 70 which operate as previously described. However, since each packing device encounters only one-half of the total number of bags coming from product drum 24, the packing fingers on each device are operated at exactly one-half the rate of previous systems. It will be appreciated that additional transfer drums may be positioned in series with the dual drum arrangement shown, or positioned about the periphery of the product drum as shown in greater detail in the FIG. 3 embodiment below. Thus, the packing fingers may be operated at 1/X the rate of previous systems, where X is the total number of transfer drums. Thus, for a four transfer drum system, packers fingers 62 would be operated at ¼ the rate of previous systems.

Further, it has been found that the orbit diameter of the packer fingers plays a role in the velocity of the fingers relative to the bags as they are removed from the product drum. As previously stated, it is desirable for the relative velocity of the packer fingers to be equal to or less than the velocity of the bags as they are removed. This tends to cause the bags to decelerate as they are removed and stacked against a backstop. For a given number of orbits per unit of time, the velocity of the packer fingers will be $\pi \times d$ times the number of orbits, where d is the diameter of the orbit. Thus, the smallest practical diameter orbit for the packer fingers is preferred as this will be the condition where the velocity of the packer fingers relative to the velocity of the bags is most likely to be a negative number (i.e., the relative velocity is in a direction opposite the velocity of the bags and will tend to decelerate the bags). We have found that if the ratio of the orbit diameter to the bag width (i.e., the product width or repeat length in the machine direction on the product drum) is less than or equal to about 0.7 the velocity of the surface of the packer fingers relative to the initial velocity of the bags (initial velocity being the velocity as the bag is stripped from the drum) will be a negative number for the entire time of contact between the two. This operating condition tends to decelerate the bags as they come into contact with the slower moving fingers, reducing bag crumpling, fold over, and bounce problems as the bags are stacked.

Figure 3:
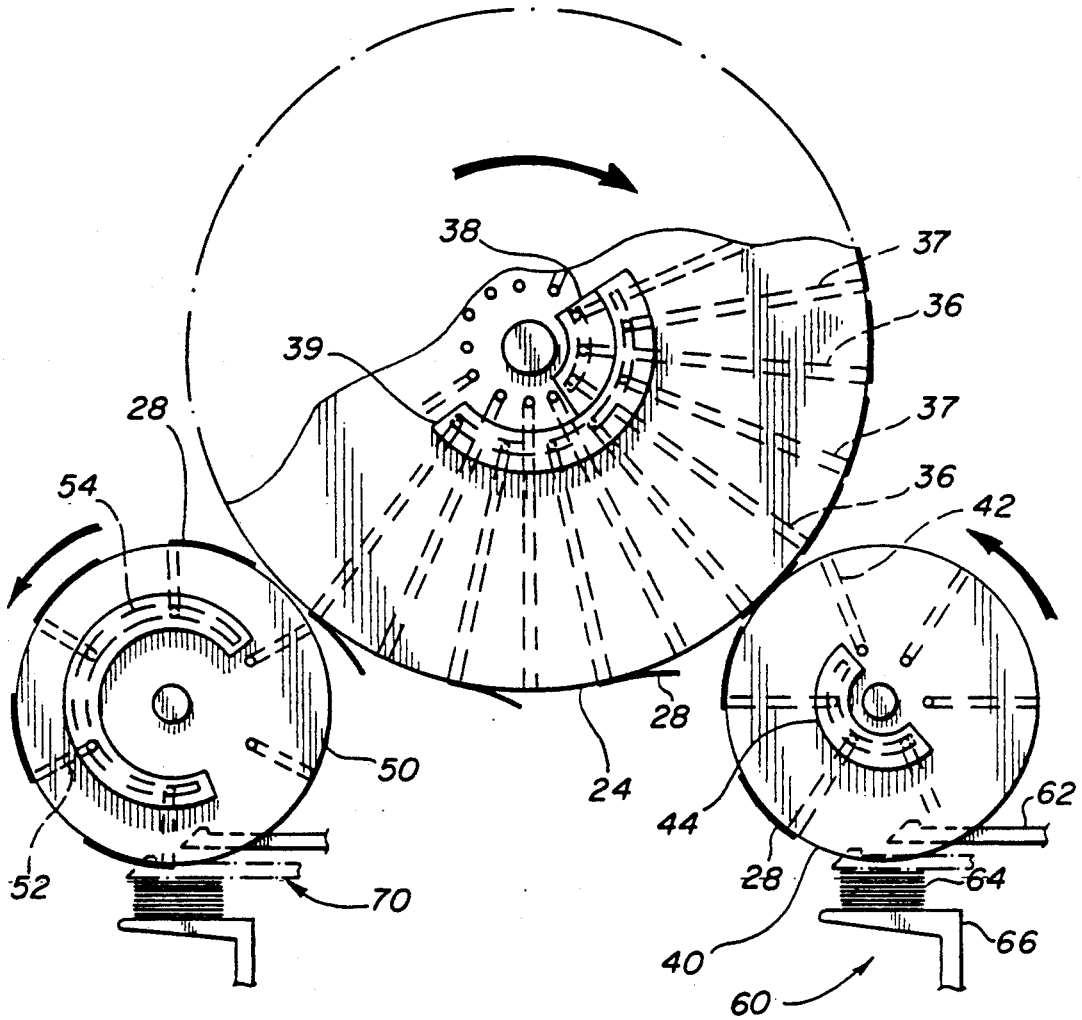
FIG. 3 is a schematic side elevational view of another dual transfer drum embodiment of the sequential handling and delivery system of the present invention.

FIG. 3 illustrates an alternate embodiment of the invention illustrated in FIG. 2A. Again, like reference numerals represent like elements. The first and second transfer drums 40 and 50, respectively, are positioned at different transfer points around the periphery of product drum 24. As shown, in this embodiment, product drum 24 is equipped with a first set of vacuum ports 36 as well as a second set of ports 37. Each set of ports communicates with respective central manifolds 38, 39 which communicate with a vacuum source (not shown). With the product and transfer drums rotating in the directions indicated by the arrows, it can be seen that the vacuum on ports 36 is released at a point approximately along the centerline between the product drum 24 and first transfer drum 40.

Bags 28 transferred to first transfer drum 40 are then delivered to packing device 60 for stacking and counting as previously described. That portion of the bags which are held by ports 37 are carried with product drum 24 until the vacuum is released at a point approximately along the centerline between product drum 24 and second transfer drum 50. Again, bags which are released to second transfer drum 50 are then delivered to packing device 70 for stacking and counting. Also again, the packing fingers in each device need only be operated at 1/X the rate of the total number of bags coming from product drum 24, where X is the number of transfer drums used.

Figure 4:
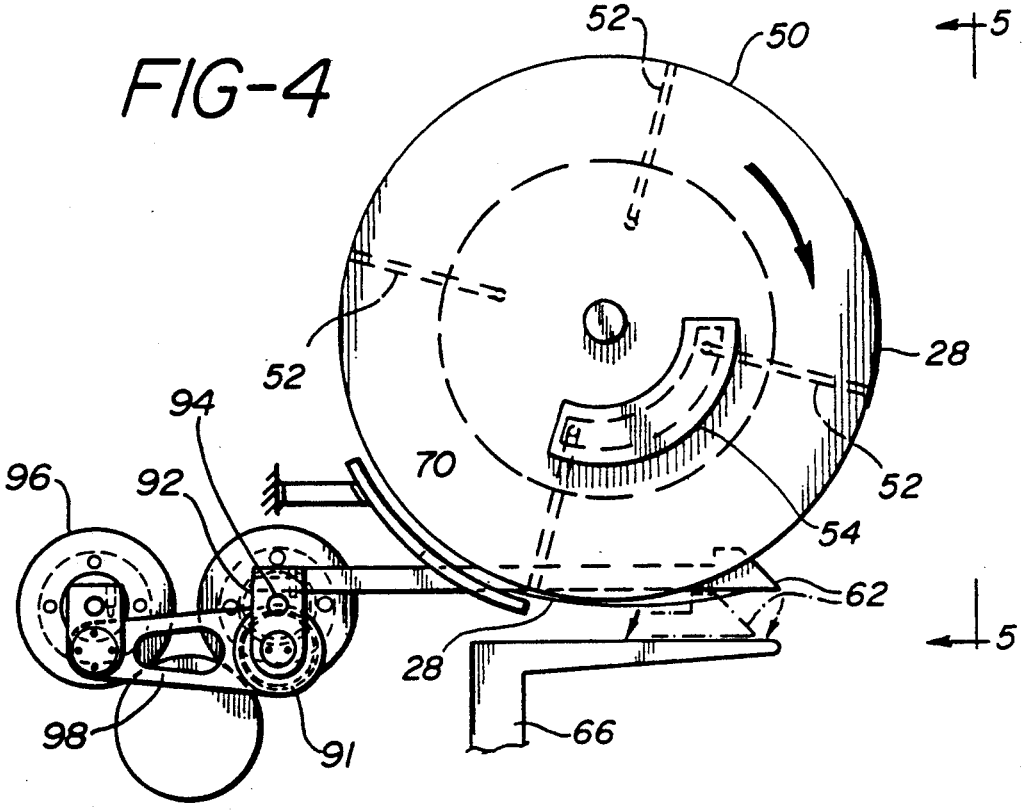
FIG. 4 is an enlarged side elevational view of one of the transfer drums shown in FIG. 2 illustrating the orbital movement of the packer fingers.
Figure 5:
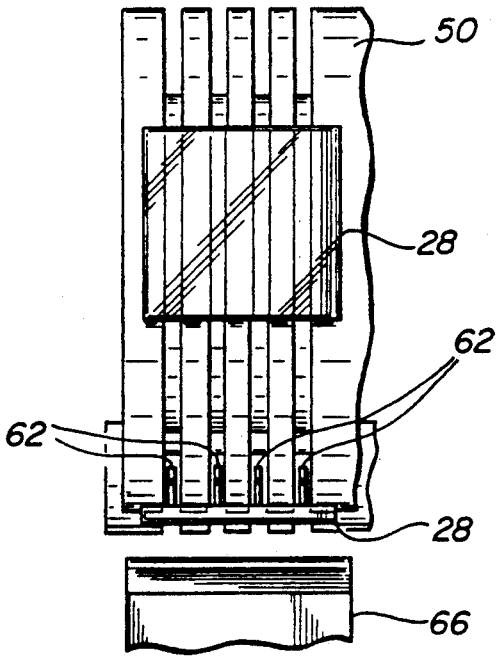
FIG. 5 is an enlarged front elevational view taken along line 5—5 in FIG. 4 illustrating the packer fingers within the annular grooves in the drum.

The positioning and operation of packer fingers 62 is best shown in FIGS. 4 and 5, with reference to the embodiment of the invention illustrated in FIG. 3. As shown, a series of packer fingers 62 extend into a corresponding series of annular grooves 69 extending around the surface of transfer drum 50. The length of the fingers is such that when they fully engage the product, as shown in FIG. 4, the ends of the fingers extend substantially across the full radial width of bags 28 as the bags are stripped from drum 50. Such full contact by the fingers prevents bag fold over problems as the bags are removed from the drum and stacked.

Also illustrated in FIG. 4 are portions of the orbital packing machinery for driving the fingers. The operation of the fingers is shown to be in a generally circular orbit. However, other configurations such as elliptical orbits may be utilized. A tube 91, which extends transversely of the packing machine, is equipped with a bracket 92 which carries packer fingers 62. Tube 91 is connected at each of its ends to crank mechanisms (not shown) which are carried on rotating shaft 94. Tube 91 is also connected to a second crank mechanism 96 by means of a connecting bar 98. Shaft 94 is driven by suitable drive means (not shown). The construction and operation of the orbital packer is described in greater detail in U.S. Pat. No. 3,640,050, the disclosure of which is incorporated by reference.

Figure 6:
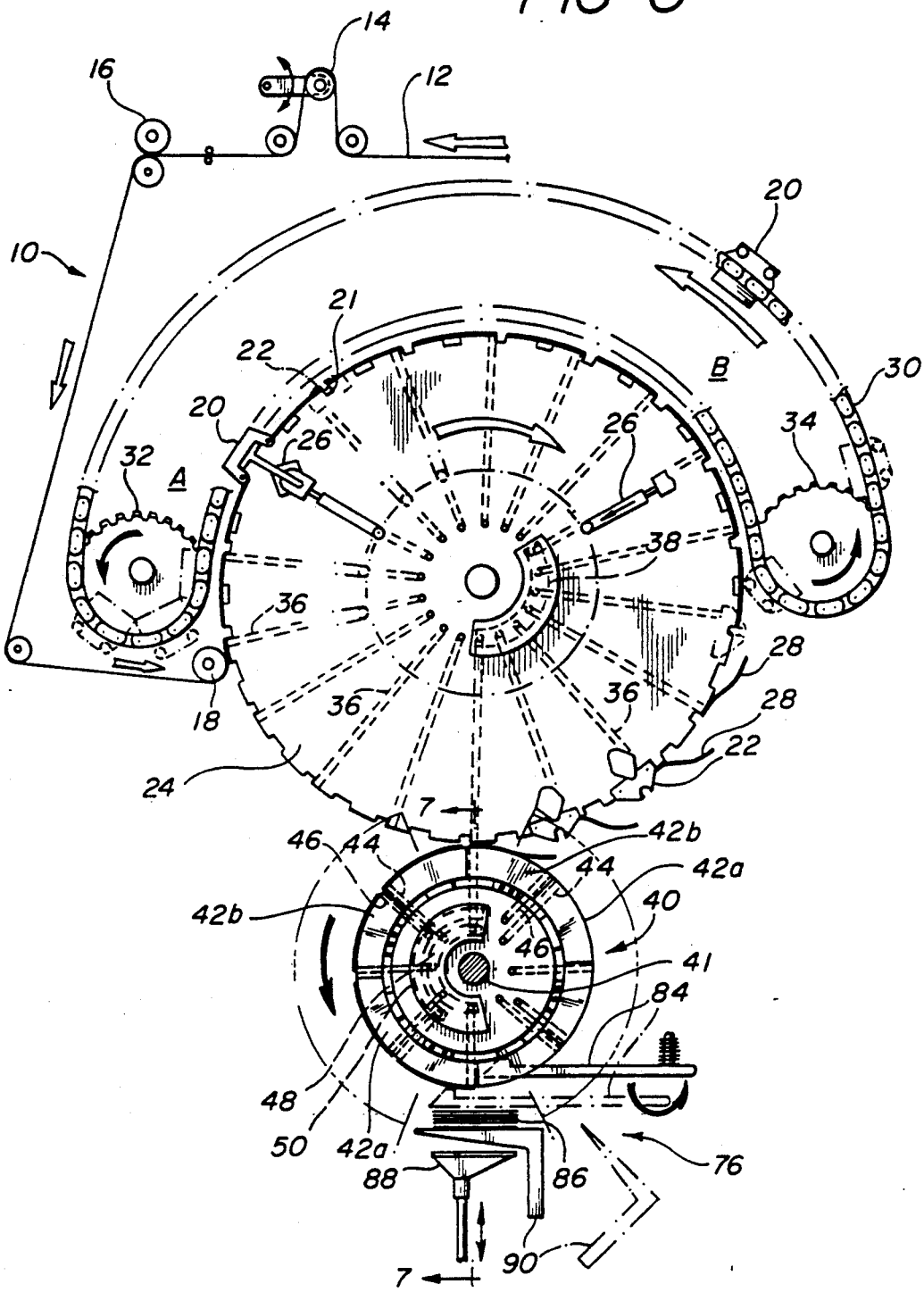
FIG. 6 is a schematic side elevational view of a side-shifting transfer drum embodiment of the sequential handling and delivery system of the present invention.
Figure 7:
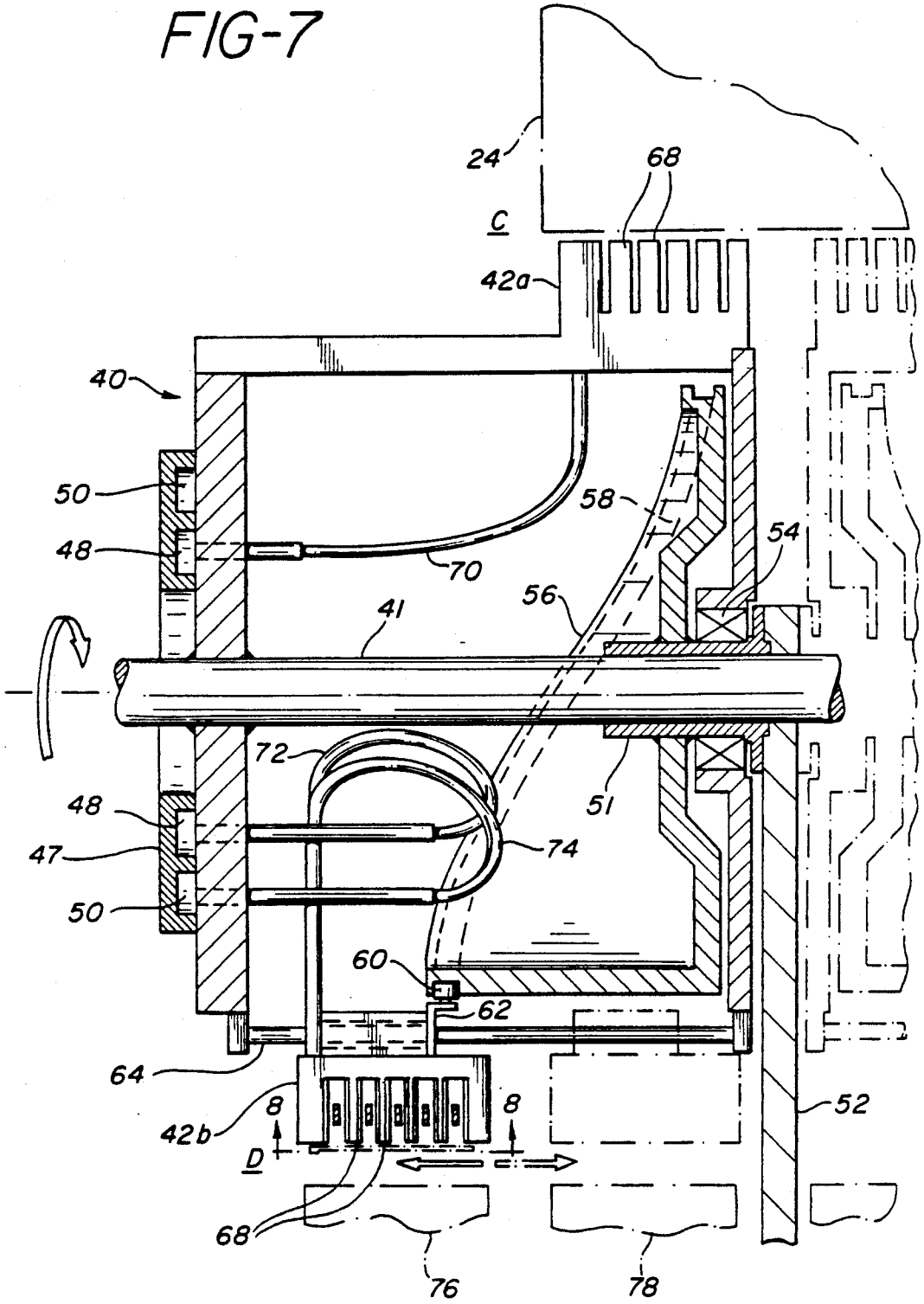
FIG. 7 is a sectional view, taken along line 7—7 in FIG. 6.

Referring now to FIGS. 6 and 7, yet another embodiment of the present invention utilizing a side-shifting transfer drum is illustrated in schematic form. Like reference numerals again represent like elements. The operation of the system is as previously described except for the construction of transfer drum 40. Transfer drum 40 is driven by suitable drive means (not shown) through shaft 41. Alternatively, shaft 41 may be fixed, and transfer drum 40 rotated about the shaft. Transfer drum 40 includes a plurality of segments **42*a* and 42*b*. In the preferred form of the invention as shown, segments 42*a* and 42*b* alternate about the periphery of the drum with segments 42*a* being fixed while segments 42*b* are movable transversely to the direction of rotation of drum 40**.

Both fixed segments **42*a* and movable segments 42*b* include a first set of vacuum ports 44 in communication with a central manifold 48. Manifold 48 is in turn in communication with a vacuum source (not shown). As shown, vacuum ports 44 are positioned to secure the leading edges of each of the respective bags 28 as they are transferred to drum 40**.

Segments **42*b* also include a second set of vacuum ports 46 which are in communication with a central manifold 50. Manifold 50 is in turn in communication with a vacuum source (not shown). Both manifolds 48 and 50 are part of a housing 47 which is located on the side of drum 40. Vacuum ports 46 are positioned to secure the trailing edges of bags 28 as they are transferred to drum 40. By securing both the leading and trailing edges of bags 28** to the movable segments, wrinkling or folding of the bags is prevented during transverse movement thereof.

Referring now to FIG. 7, the structure and operation of transfer drum 40 are illustrated in greater detail. Drum 40 is mounted on drive shaft 41 which is in turn supported in a sleeve 51 secured to center support plate 52. Bearings permit the rotation of drum 40 around fixed sleeve 51. For ease of explanation, only one half of transfer drum 40 is shown in FIG. 7. It will be appreciated that a mirror image of the portion of the drum which is illustrated extends from the opposite side of center support plate 52 and is partially shown in phantom lines.

Positioned within drum 40 is a cam 56 having a cam track 58. Cam 56 is secured to sleeve 51 by suitable means. A cam follower 60 secured to each movable segment **42*b*, such as by bracket 62, rides in cam track 58. Movable segments 42*b* are also mounted on bearings or the like for transverse movement on slide bars 64. Rotation of drum 40 about its longitudinal axis causes movable segments 42*b* to translate as shown along slide bars 64 to move from position C in alignment with bags from product drum 24 at the transfer point between the two drums to position D at the opposite side of transfer drum 40**.

Fixed segments **42*a* have finger segments 68 with annular grooves 69 therebetween to facilitate removal of the bags 28 by the orbital packing fingers on the orbital packing device described in greater detail below. Flexible vacuum hose 70 supplies a source of vacuum from manifold 48 to vacuum ports 44 on the surface of segments 42*a* to secure the leading edges of bags 28** thereto.

Figure 8:
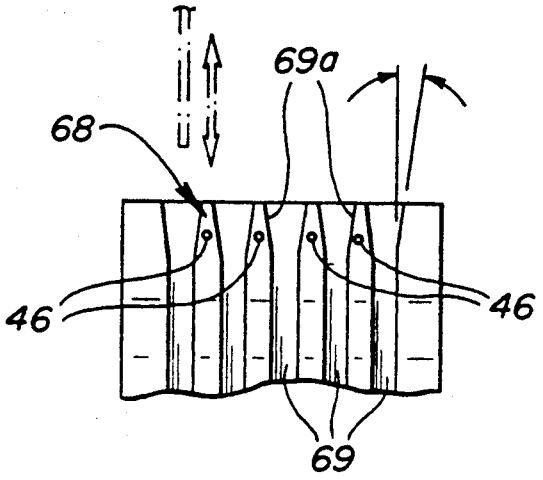
FIG. 8 is a front elevational view taken along line 8—8 in FIG. 7.

Movable segments **42*b* also preferably include finger segments 68 having annular grooves 69 therebetween. As shown in FIG. 8, grooves 69 may have tapered entry sections 69*a* to facilitate movement of the finger segments 68 into and out of the grooves. Further, grooves 69 are designed to be about twice the width of finger segments 68 for moveable segments 42*b*. Finally, optionally, vertical guides 70, best shown in FIG. 4, may be positioned alongside individual ones of the finger segments for maintaining the fingers in alignment with grooves 69. All of these features allow for and/or correct any misalignment of the fingers and grooves due to the extended length of the fingers and the side-shifting of the segments on the transfer drum. Flexible vacuum hoses 72 and 74 provide a source of vacuum from manifolds 48 and 50, respectively, to vacuum ports 44 and 46 on the surface of the movable segments. In this manner, both the leading and trailing edges of bags 28 are secured to movable segments 42*b***.

In operation, pairs of bags 28 are transferred from product drum 24 to transfer drum 40 as the two drums rotate in opposite directions. At the point of transfer, the vacuum on the leading edge of the bag on the product drum is released, and the bag falls onto transfer drum 40 where the leading edge is immediately secured by vacuum ports 44. It will be understood that bags 28 will fall sequentially onto either a fixed segment **42*a* or movable segment 42*b*. As transfer drum 40 continues to rotate, if the bag is on a movable segment 42*b*, vacuum ports 46** will be activated to secure the trailing edge of the bag.

As drum 40 rotates, both fixed and movable segments **42*a* and 42*b* are positioned directly beneath the transfer point on product drum 24. As drum 40 continues to rotate, movable segments 42*b* will begin to translate laterally as cam 56 causes cam follower 60 to move laterally in cam track 58. At a predetermined point in the rotation of drum 40, movable segments 42*b* are at their outwardmost position on drum 40, in alignment with packing device 76. Fixed segments 42*a* continue to rotate in alignment with packing device 78**.

As illustrated in FIG. 7, the predetermined point at which movable segments **42*b* reach their outwardmost travel is approximately 180 degrees from the transfer point between drums 24 and 40. Cam 56 is designed so that after reaching the point of outermost travel and transferring the bags to the packing equipment, movable segments 42*b* begin to translate inwardly so that they are back into alignment with the streams of bags leaving product drum 24 by the time that drum 40** rotates them back to that position.

In this manner, the two streams of individual bags may be divided into four streams which can then be delivered to separate packing devices. The operation of those packing devices is the same and will be described in greater detail in relation to device 76 as best shown in FIG. 6. As bags 28 are brought around transfer drum 40, the bags secured by vacuum ports 44 hold onto the bags until they reach a nearly horizontal position where the vacuum is released. Also as shown, those movable segments 42b in which the trailing edges of the bags are secured by vacuum ports 46 have that vacuum released just prior to reaching the transfer point and after the segments have been side-shifted to their outermost point.

In packing device 76, orbital packer fingers 84 extend into annular grooves 69 and pull the individual bags away from the drum surface and then deposit the bags into a stack 86 on delivery table 88. As shown in phantom lines, the fingers are designed to extend across substantially the entire radial width of the bags as they are removed from the transfer drum. At a precise time, count fingers 90 pivot between the position shown in phantom lines completely out of the stream of bags into the position shown to separate the stack 86 of bags into the desired count. The delivery table 88 may be lowered to permit a clamp assembly (not shown) to clamp the stack of bags and transfer it to further conventional equipment for packaging the bags.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An orbital packing apparatus for sequentially handling individual flexible products comprising:

a shaft mounted for orbital movement, including drive means for orbiting said shaft; and a plurality of fingers secured to said shaft, said fingers having surfaces adapted to contact said flexible products, said surfaces including means for providing a selective frictional drag between said flexible products and said fingers such that there is a high degree of friction when said flexible products are moving at a high velocity relative to said finger surfaces and a low degree of friction when the velocity of said finger surfaces is increasing relative to the velocity of said flexible products.

2. The apparatus of claim 1 in which said selective frictional drag providing means comprise a saw-toothed pattern.

3. The apparatus of claim 1 in which said selective frictional drag providing means comprise a fish scale pattern.

4. The apparatus of claim 1 in which said selective frictional drag providing means comprise a series of angled projections.

5. An apparatus for the sequential handling of individual flexible products comprising:

means for delivering a series of individual flexible products to a transfer point;

means positioned at said transfer point for transferring said flexible products to a delivery point, said means including a vacuum transfer drum having a plurality of annular grooves extending inwardly substantially normal to the axis of rotation of said drum about the periphery thereof and means for rotating said drum;

a shaft mounted adjacent said transfer drum for orbital movement, including drive means for orbiting said shaft;

a plurality of fingers secured to said shaft and extending into said annular grooves for removing said flexible products sequentially from said transfer drum and delivering them to said delivery point, said fingers extending and contacting across substantially the full radial width of said flexible products as said products are removed from said transfer drum.

6. An apparatus for the sequential handling of individual flexible products comprising:

means for delivering a series of individual flexible products to a transfer point;

means positioned at said transfer point for transferring said flexible products to a delivery point, said means including a vacuum transfer drum having a plurality of annular grooves about the periphery thereof and means for rotating said drum;

a shaft mounted adjacent said transfer drum for orbital movement, including drive means for orbiting said shaft;

a plurality of fingers secured to said shaft and extending into said annular grooves for removing said flexible products sequentially from said transfer drum and delivering them to said delivery point, said fingers extending and contacting across substantially the full width of said flexible products as said products are removed from said transfer drum, and wherein said surfaces of said fingers in contact with said flexible products include means for providing a selective frictional drag between said flexible products and said fingers such that there is a high degree of friction when said flexible products are moving at a high velocity relative to said finger surfaces and a low degree of friction when the velocity of said finger surfaces is increasing relative to the velocity of said flexible products.

7. A high speed multiple lane system for delivering a series of individual flexible products to a plurality of delivery points comprising:

means for providing a series of individual flexible products to a transfer point;

means for transferring individual ones of said flexible products from said transfer point to a plurality of delivery points;

said transfer means including a vacuum transfer drum having a plurality of annular grooves extending inwardly substantially normal to the axis of rotation of said drum about the periphery thereof, and means for rotating said vacuum transfer drum;

said transfer drum also including a plurality of alternating first and second segments, said first segments being movable transverse to the path of movement of said flexible products, said first segments adopted to accept alternating ones of said flexible products from said transfer point and including vacuum ports in communication with said vacuum source for securing the leading edges of said flexible products, said second segments adapted to accept alternating ones of said flexible products, and means for moving said first segments transverse to said path of movement of said flexible products;

a shaft mounted adjacent said transfer drum for orbital movement, including drive means for orbiting said shaft;

a plurality of fingers secured to said shaft and extending into said annular grooves for removing said flexible products sequentially from said first and second segments on said transfer drum and delivering them to said plurality of delivery points, said fingers extending and contacting across substantially the full radial width of said flexible products as said products are removed from said transfer drum.

8. The apparatus of claim 7 in which the ratio of the orbit diameter of said fingers to the width of said flexible products is equal to or less than about 0.7.

9. The apparatus of claim 7 in which said fingers are operated at a rate of 1/X times the rate that said flexible products are provided to said transfer point.

10. A high speed multiple lane system for delivering a series of individual flexible products to a plurality of delivery points comprising:

means for providing a series of individual flexible products to a transfer point;

means for transferring individual ones of said flexible products from said transfer point to a plurality of delivery points;

said transfer means including a vacuum transfer drum having a plurality of annular grooves about the periphery thereof, and means for rotating said vacuum transfer drum;

said transfer drum also including a plurality of alternating first and second segments, said first segments being movable transverse to the path of movement of said flexible products, said first segments adapted to accept alternating ones of said flexible products from said transfer point and including vacuum ports in communication with said vacuum source for securing the leading edges of said flexible products, said second segments adapted to accept alternating ones of said flexible products, and means for moving said first segments transverse to said path of movement of said flexible products;

a shaft mounted adjacent said transfer drum for orbital movement, including drive means for orbiting said shaft;

a plurality of fingers secured to said shaft and extending into said annular grooves for removing said flexible products sequentially from said first and second segments on said transfer drum and delivering them to said plurality of delivery points, said fingers extending and contacting across substantially the full width of said flexible products as said products are removed from said transfer drum, and where the velocity of said fingers relative to the velocity of said flexible products as said products are removed from said transfer drum is of a magnitude and direction which will tend to decelerate said flexible products.

11. A high speed multiple lane system for delivering a series of individual flexible products to a plurality of delivery points comprising:

means for providing a series of individual flexible products to a transfer point;

means for transferring individual ones of said flexible products from said transfer point to a plurality of delivery point;

said transfer means including a vacuum transfer drum having a plurality of annular grooves about the periphery thereof, and means for rotating said vacuum transfer drum;

said transfer drum also including a plurality of alternating first and second segments, said first segments being movable transverse to the path of movement of said flexible products, said first segments adapted to accept alternating ones of said flexible products from said transfer point and including vacuum ports in communication with said vacuum source for securing the leading edges of said flexible products, said second segments adapted to accept alternating ones of said flexible products, and means for moving said first segments transverse to said path of movement of said flexible products;

a shaft mounted adjacent said transfer drum for orbital movement, including drive means for orbiting said shaft;

a plurality of fingers secured to said shaft and extending into said annular grooves for removing said flexible products sequentially from said first and second segments on said transfer drum and delivering them to said plurality of delivery points, said fingers extending and contacting across substantially the full width of said flexible products as said products are removed from said transfer drum, and wherein said surfaces of said fingers in contact with said flexible products include means for providing a selective frictional drag between said flexible products and said fingers such that there is a high degree of friction when said flexible products are moving at a high velocity relative to said finger surfaces and a low degree of friction when the velocity of said finger surfaces is increasing relative to the velocity of said flexible products.

12. A high speed products delivery system comprising:

means for providing a series of individual flexible products sequentially to a transfer point; and means for transferring individual ones of said products from said transfer point to a plurality of delivery points, said transfer means including a plurality of vacuum transfer drums, each of said drums having a plurality of annular grooves extending inwardly substantially normal to the axis of rotation of said drums about the periphery thereof, and means for rotating said drums, said drums arranged such that the first of said plurality of transfer drums accepts products from said providing means and transfers at least a portion of said individual products to a succeeding transfer drum and at least a portion of said individual products to a first delivery point, each succeeding transfer drum delivering at least that portion of said individual products received from said first transfer drum to succeeding delivery points;

shafts adjacent each of said transfer drums adjacent said delivery points mounted for orbital movement including drive means for orbiting said shafts;

a plurality of fingers secured to each shaft and extending into said annular grooves on said transfer drums for removing said flexible products sequentially from said transfer drums and delivering them to said plurality of delivery points, said fingers extending and contacting across substantially the full radial width of said flexible products as said products are removed form said transfer drums.

13. The apparatus of claim 12 in which the ratio of the orbit diameter of said fingers to the width of said flexible products is equal to or less than about 0.7.

14. The apparatus of claim 12 in which said fingers are operated at a rate of 1/X times the rate that said flexible products are provided to said transfer point, where X is the number of delivery points per lane of flexible products provided to said transfer point, and $X \geqq 2$.

15. A high speed product delivery system comprising:

means for providing a series of individual flexible products sequentially to a transfer point; and means for transferring individual ones of said products from said transfer point to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products form said providing means and transfers at least a portion of said individual products to a succeeding transfer drum and at least a portion of said individual products to a first delivery point, each succeeding transfer drum delivering at least that portion of said individual products received from said first transfer drum to succeeding delivery points;

shafts adjacent each of said transfer drums adjacent said delivery points mounted for orbital movement including drive means for orbiting said shafts;

a plurality of fingers secured to each shaft and extending into said annular grooves on said transfer drums for removing said flexible products sequentially from said transfer drums and delivering them to said plurality of delivery points, said fingers extending and contacting across substantially the full width of said flexible products as said products are removed from said transfer drums, and wherein the velocity of said fingers relative to the velocity of said flexible products as said products are removed from said transfer drum is of a magnitude and direction which will tend to decelerate said flexible products.

16. A high speed product delivery system comprising:

means for providing a series of individual flexible products sequentially to a transfer point; and means for transferring individual ones of said products from said transfer point to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products from said providing means and transfers at least a portion of said individual products to a succeeding transfer drum and at least a portion of said individual products to a first delivery point, each succeeding transfer drum delivering at least that portion of said individual products received from said first transfer drum to succeeding delivery points;

shafts adjacent each of said transfer drums adjacent said delivery points mounted for orbital movement including drive means for orbiting said shafts;

a plurality of fingers secured to each shaft and extending into said annular grooves on said transfer drums for removing said flexible products sequentially from said transfer drums and delivering them to said plurality of delivery points, said fingers extending and contacting across substantially the full width of said flexible products as said products are removed from said transfer drums, and wherein said surfaces of said fingers in contact with said flexible products include means for providing a selective frictional drag between said flexible products and said fingers such that there is a high degree of friction when said flexible products are moving at a high velocity relative to said finger surfaces and a low degree of friction when the velocity of said finger surfaces is increasing relative to the velocity of said flexible products.

17. A high speed product delivery system comprising:

means for providing a series of individual flexible web products sequentially to a plurality of transfer points;

means for transferring individual ones of said products from each of said plurality of transfer points to a plurality of delivery points, said transfer means including a plurality of vacuum transfer drums, each of said drums having a plurality of annular grooves extending inwardly substantially normal to the axis of rotation of said drums about the periphery thereof, and means for rotating said drums, said drums arranged such that the first of said plurality of transfer drums accepts products from said providing means at a first transfer point and each succeeding transfer drum accepts individual products from said providing means at each succeeding transfer point, said first transfer drum delivering at least a portion of said individual products to a first delivery point, and each succeeding transfer drum located at each succeeding transfer point delivering at least a portion of said individual products to succeeding delivery points;

shafts adjacent each of said transfer drums adjacent said delivery points mounted for orbital movement including drive means for orbiting said shafts; and a plurality of fingers secured to each shaft and extending into said annular grooves on said transfer drums for removing said flexible products sequentially from said transfer drums and delivering them to said plurality of delivery points, said fingers extending and contacting across substantially the full radial width of said flexible products as said products are removed from said transfer drums.

18. The apparatus of claim 17 in which the ratio of the orbit diameter of said fingers to the width of said flexible products is equal to or less than about 0.7.

19. The apparatus of claim 17 in which said fingers are operated at a rate of 1X times the rate that said flexible products ar provide to said transfer point, where X is the number of delivery points per lane of flexible products provided to said transfer points and X is $\geqq 2$.

20. A high speed product delivery system comprising:

means for providing a series of individual flexible web products sequentially to a plurality of transfer points;

means for transferring individual ones of said products from each of said plurality of transfer points to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products from said providing means at a first transfer point and each succeeding transfer drum accepts individual products from said providing means at each succeeding transfer point, said first transfer drum delivering at least a portion of said individual products to a first delivery point, and each succeeding transfer drum located at each succeeding transfer point delivering at least a portion of said individual products to succeeding delivery points;

shafts adjacent each of said transfer drums adjacent said delivery points mounted for orbital movement including drive means for orbiting said shafts; and a plurality of fingers secured to each shaft and extending into said annular grooves on said transfer drums for removing said flexible products sequentially from said transfer drums and delivering them to said plurality of delivery points, said fingers extending and contacting across substantially the full width of said flexible products as said products are removed from said transfer drums, and wherein the velocity of said fingers relative to the velocity of said flexible products as said products are removed from said transfer drums is of a magnitude and direction which will tend to decelerate said flexible products.

21. A high speed product delivery system comprising:

means for providing a series of individual flexible web products sequentially to a plurality of transfer points;

means for transferring individual ones of said products from each of said plurality of transfer points to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products from said providing means at a first transfer point and each succeeding transfer drum accepts individual products from said providing means at each succeeding transfer point, said first transfer drum delivering at least a portion of said individual products to a first delivery point, and each succeeding transfer drum located at each succeeding transfer point delivering at least a portion of said individual products to succeeding delivery points;

shafts adjacent each of said transfer drums adjacent said delivery points mounted for orbital movement including drive means for orbiting said shafts; and a plurality of fingers secured to each shaft and extending into said annular grooves on said transfer drums for removing said flexible products sequentially from said transfer drums and delivering them to said plurality of delivery points, said fingers extending and contacting across substantially the full width of said flexible products as said products are removed from said transfer drums, and wherein said surfaces of said fingers in contact with said flexible products include means for providing a selective frictional drag between said flexible products and said fingers such that there is high degree of friction when said flexible products are moving at a high velocity relative to said finger surfaces and a low degree of friction when the velocity of said finger surfaces is increasing relative to the velocity of said flexible products.

22. A high speed multiple lane system for delivering a series of individual flexible products to a plurality of delivery points comprising:

means for providing a series of individual flexible products to a transfer point;

means for transferring individual ones of said flexible products from said transfer point to a plurality of delivery points;

said transfer means including a vacuum transfer drum having a plurality of annular grooves about the periphery thereof, and means for rotating said vacuum transfer drum;

said transfer drum also including a plurality of alternating first and second segments, said first segments being movable transverse to the path of movement of said flexible products, said first segments adapted to accept alternating ones of said flexible products from said transfer point and including vacuum ports in communication with said vacuum source for securing the leading edges of said flexible products, said second segments adapted to accept alternating ones of said flexible products, and means for moving said first segments transverse to said path of movement of said flexible products;

a shaft mounted adjacent said transfer drum for orbital movement, including drive means for orbiting said shaft;

a plurality of fingers secured to said shaft and extending into said annular grooves for removing said flexible products sequentially from said first and second segments on said transfer drum and delivering them to said plurality of delivery points, said fingers being operated at a rate of 1/X times the rate that said flexible products are provided to said transfer point, where X is the number of delivery points per lane of flexible products provided to said transfer point X is $\geqq 2$, and in which the ratio of the orbit diameter of said fingers to the width of said flexible products is equal to or less than about 0.7.

23. A high speed product delivery system comprising:

means for providing a series of individual flexible products sequentially to a transfer point; and means for transferring individual ones of said products from said transfer point to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products from said providing means and transfers at least a portion of said individual products to a succeeding transfer drum and at least a portion of said individual products to a first delivery point, each succeeding transfer drum delivering at least that portion of said individual products received from said first transfer drum to succeeding delivery points;

shafts adjacent each of said transfer drums adjacent said delivery points mounted for orbital movement including drive means for orbiting said shafts;

a plurality of fingers secured to each shaft and extending into said annular grooves on said transfer drums for removing said flexible products sequentially from said transfer drums and delivering them to said plurality of delivery points, said fingers being operated at a rate of 1/X times the rate that said flexible products are provided to said transfer point, where X is the number of delivery points per lane of flexible products provided to said transfer point and $X \geqq 2$, and, in which the ratio of the orbit diameter of said fingers to the width of said flexible products is equal to or less than about 0.7.

24. A high speed product delivery system comprising:

means for providing a series of individual flexible web products sequentially to a plurality of transfer points;

means for transferring individual ones of said products from each of said plurality of transfer points to a plurality of delivery points, said transfer means including a plurality of vacuum transfer drums, each of said drums having a plurality of annular grooves about the periphery thereof, and means for rotating said drums, said drums arranged such that the first of said plurality of transfer drums accepts products from said providing means at a first transfer point and each succeeding transfer drum accepts individual products from said providing means at each succeeding transfer point, said first transfer drum delivering at least a portion of said individual products to a first delivery point, and each succeeding transfer drum located at each succeeding transfer point delivering at least a portion of said individual products to succeeding delivery points;

shafts adjacent each of said transfer drums adjacent said delivery points mounted for orbital movement including drive means for orbiting said shafts; and a plurality of fingers secured to each shaft and extending into said annular grooves on said transfer drums for removing said flexible products sequentially from said transfer drums and delivering them to said plurality of delivery points, said fingers being operated at a rate of 1/X times the rate that said flexible products are provided to said transfer point, where X is the number of delivery points per lane of flexible products provided to said transfer points and X is $\geqq 2$, and, in which the ratio of the orbit diameter of said fingers to the width of said flexible products is equal to or less than about 0.7.

25. A method for the sequential handling of individual flexible products comprising the steps of:

delivering a series of individual flexible products to a transfer point;

transferring said flexible products from said transfer point to a plurality of delivery points by transferring said flexible products onto a rotating vacuum transfer drum having a plurality of annular grooves about the periphery thereof;

removing said flexible products sequentially from said transfer drum and delivering them to said plurality delivery points using a plurality of fingers which extend into said annular grooves and remove said flexible products sequentially from said transfer drum and deliver them to said plurality of delivery points, said fingers being operated at a rate of 1/X times the rate that said flexible products are provided to said transfer point, where X is the number of delivery points per lane of flexible products delivered to said transfer point and X is $\geqq 2$, and in which the ratio of the orbit diameter of said fingers to the width of said flexible products is equal to or less than about 0.7.

26. A method for the sequential handling of individual flexible products comprising the steps of:

delivering a series of individual flexible products to a transfer point;

transferring said flexible products from said transfer point to a delivery point by transferring said flexible products onto a rotating vacuum transfer drum having a plurality of annular grooves extending inwardly substantially normal to the axis of rotation of said drum about the periphery thereof;

removing said flexible products sequentially from said transfer drum and delivering them to said delivery point using a plurality of fingers which extend into said annular grooves and remove said flexible products sequentially from said transfer drum and deliver them to said delivery point, said fingers extending and contacting across substantially the full radial width of said flexible products as said products are removed from said transfer drum.

27. The method of claim 26 in which the velocity of said fingers relative to the velocity of said flexible products as said products are removed from said transfer drum is of a magnitude and direction which will tend to decelerate said flexible products.

28. The method of claim 26 in which the ratio of the orbit diameter of said fingers to the width of said flexible products is equal to or less than about 0.7.

* * * * *

UNITED STATES PATENT AND TRADEMARK OFFICE

CERTIFICATE OF CORRECTION

PATENT NO. : 5,014,978

DATED : May 14, 1991

INVENTOR(S) : David A. Smith and Herb Geiger

It is certified that error appears in the above-identified patent and that said Letters Patent is hereby corrected as shown below:

Cover Page, Abstract, last line, following "backstop." insert --In one embodiment, the apparatus includes means for delivering a series of individual flexible products to a transfer point and means positioned at the transfer point for transferring the flexible products to a delivery point. The means at the transfer point include a vacuum transfer drum having a plurality of annular grooves about the periphery thereof and means for rotating the drum. Adjacent the transfer drum is an orbital packing mechanism including a shaft positioned for orbital movement, drive means for orbiting the shaft, and a plurality of packer fingers secured to the shaft and extending into the annular grooves on the transfer drum for removing the flexible products sequentially from the transfer drum and delivering them to the delivery point.--

UNITED STATES PATENT AND TRADEMARK OFFICE

CERTIFICATE OF CORRECTION

PATENT NO. : 5,014,978

DATED : May 14, 1991

INVENTOR(S) : David A. Smith and Herb Geiger

It is certified that error appears in the above-identified patent and that said Letters Patent is hereby corrected as shown below:

Column 15, line 15, following "point" insert --and X is ≥ 2--.

Column 15, line 64, "point" should correctly read --points--.

Column 18, line 52, "1X" should correctly read --1/X--.

Column 18, line 53 "ar" should correctly read --are--.

Column 19, line 65, following "is" insert --a--.

Signed and Sealed this

Twenty-ninth Day of December, 1992

*Attest:*

*Attesting Officer*

DOUGLAS B. COMER

*Acting Commissioner of Patents and Trademarks*